United States Patent [19]

De Brabandere et al.

[11] 4,177,071

[45] Dec. 4, 1979

[54] RAPIDLY PROCESSABLE RADIOGRAPHIC MATERIALS

[75] Inventors: Luc A. De Brabandere, Lier; Hendrik A. Borginon, Mortsel; Herman A. Pattyn, Kapellen; Robert J. Pollet, Vremde, all of Belgium

[73] Assignee: Agfa-Gevaert, N.V., Mortsel, Belgium

[21] Appl. No.: 832,662

[22] Filed: Sep. 12, 1977

[30] Foreign Application Priority Data

Oct. 7, 1976 [GB] United Kingdom ..... 41752/76

[51] Int. Cl.[2] ..... G03C 5/04; G03C 5/24; G03C 1/06; G03C 1/28

[52] U.S. Cl. ..... 430/494; 430/966; 430/603; 430/605; 430/569

[58] Field of Search ..... 250/475 F, 477, 478; 96/107, 94 R, 95, 82, 108, 27 R, 27 E

[56] References Cited

U.S. PATENT DOCUMENTS

| | | | |
|---|---|---|---|
| 3,545,971 | 12/1970 | Barnes et al. | 96/63 |
| 3,772,031 | 11/1973 | Berry et al. | 96/108 |
| 3,912,933 | 10/1975 | Van Stappen | 96/82 |
| 4,040,833 | 8/1977 | Hinata et al. | 96/82 |
| 4,057,429 | 11/1977 | De Brabandere et al. | 96/94 R |
| 4,067,739 | 1/1978 | Lewis | 96/94 R |

FOREIGN PATENT DOCUMENTS 1413748 11/1975 United Kingdom .

OTHER PUBLICATIONS

Neblette's Handbook of Photography and Reprography, pp. 550–561.

*Primary Examiner*—Mary F. Kelley
*Attorney, Agent, or Firm*—A. W. Breiner

[57] ABSTRACT

Radiographic silver halide emulsions are provided comprising silver halide grains the average silver halide grain diameter of which is at least 250 nm and which consist substantially of silver bromide dispersed in a hydrophilic colloid binder e.g. gelatin wherein the silver halide grains have high primitive surface sensitivity for direct exposure to penetrating radiation and are substantially regular in shape and wherein the ratio of hydrophilic colloid to silver halide is at most about 1.0. These emulsions have high sensitivity for direct exposure to penetrating radiation and are themselves substantially insensitive to formation of pressure marks upon rapid processing.

14 Claims, No Drawings

RAPIDLY PROCESSABLE RADIOGRAPHIC MATERIALS

The present invention relates to rapidly processable radiographic silver halide material and especially to rapidly processable radiographic material for direct exposure to penetrating radiation e.g. industrial material for nondestructive testing and medical radiographic material e.g. for use in mammography.

It is known that the overall sensitivity of silver halide emulsions increases with increasing grain-size and that highest sensitivity is reached with silver halide emulsions the halide of which consists substantially of bromide. Therefore it is common practice to employ for recording X-ray exposures relatively coarse-grained emulsions more particularly ammoniacal silver bromide emulsions which may contain minor amounts of silver iodide and silver chloride.

It is also known that the silver halide grains of conventional photographic emulsions are sensitive to radiation both on the surface and internally. The primitive emulsions i.e. the emulsions before any chemical sensitization has taken place, not only have a poor overall sensitivity but their internal sensitivity generally outranges the surface sensitivity. In most types of photographic processes, however, the surface sensitivity is more important than the internal sensitivity because normally surface developers are used, which contain little or no solvent for silver halides and which react only or predominantly with those latent image specks situated at or near the surface of the silver halide grains.

A high surface sensitivity is beneficial for recording of all types of exposures but most of all for recording exposures with high energy radiation e.g. direct exposures with penetrating radiation or exposures with short duration high intensity visible light (flash exposures of $10^{-3}$ sec or less) because with these exposures wherein the latent image forms under similar conditions namely the passage of an electron through a silver halide grain in a very short time, the distribution of the latent image between the interior and the surface of the grains is generally much more shifted to the interior than when the exposure occurs with light of low or moderate intensity (cfr. Mees and James, The theory of the photographic process, 3rd Ed., 1966, pages 126, 136 and 191).

In order to increase the overall sensitivity and more especially the surface sensitivity, the emulsions are chemically sensitized by means of sulphur sensitizers, reduction sensitizers and/or noble metal especially gold sensitizers, so as to create sensitivity specks especially at the surface of the grains whereby upon exposure of the grains latent image specks are formed at or in the immediate neighbourhood of these surface sensitivity specks.

According to Mees & James, The theory of the photographic process, 3rd Ed, 1966, page 125 sulphur sensitization generally not only increases surface sensitivity but also lowers internal sensitivity whereas reduction and gold sensitization often increase both internal and surface sensitivity. Radiographic materials for medical as well as industrial use are most commonly sensitized chemically by means of sulphur sensitization, together with gold sensitization.

Ever increasing the surface sensitivity of the emulsions by chemical sensitization is impossible because the chemical sensitization reaches a limit beyond which further addition of sensitizer or further digestion of the emulsion with the sensitizer merely increases the fog of the emulsion with constant or decreasing speed.

Direct exposures to penetrating radiation contrary to exposures with the use of fluorescent intensifying screens which are commonly employed in medical radiographic materials to convert X-ray exposures into visible light exposures and thus to reduce patient X-ray dosage substantially, have not only the disadvantage of forming predominantly internal latent image specks but also that only a small fraction of the incident radiation is absorbed by the emulsion. Therefore, commercial radiographic film materials for direct exposures to penetrating radiation which include e.g. industrail radiographic materials for non-destructive testing and medical radiographic materials for discovering breast diseases (mammography) have high coating thicknesses of silver halide which is generally an amount of silver halide corresponding to from about 13 g to about 40 g of silver nitrate per sq.m (these amounts correspond to up to six times the amount of silver halide used in common negative emulsions for visible light recording and generally more than twice the amount of silver halide used in common radiographic medical material for use with fluorescent screens).

As the thickness of the emulsion layer may prevent convenient development and fixation it is common practice to coat emulsion layers on both sides of a transparent film support. Moreover, it is generally desirable to limit the processing time of exposed photographic elements to a minimum. Techniques for rapid processing of exposed photographic elements are known. Usually, rapid processing occurs in automatic processing machines where the materials are conducted from one processing station to another by means of roller pairs or other transporting means. In order to accelerate processing of the radiographic materials it is not only desirable for the silver halide to be provided on both sides of the support but also to limit the content of hydrophilic colloid binder in the emulsion layers so that penetration of processing liquids is accelerated.

In these elements the weight ratio of hydrophilic colloid more particularly gelatin to silver halide, expressed as silver nitrate is generally at most about 1.0.

Radiographic silver halide elements of the type described hereinbefore having high coating thicknesses of silver halide and in order to allow rapid processing having a low content of hydrophilic binder, show inferior image quality upon exposure and rapid-processing in automatic processing machines. The severe physical conditions to which the elements are subjected in the apparatus e.g. pressure and usually elevated temperature results in the formation of repeated pressure marks in the image, e.g. from roller pairs and other guiding means. These marks are highly undesirable in radiographic images as they may affect interpretation thereof.

In order to reduce the tendency to formation of pressure marks in silver halide emulsions, it has been described in the art to add to the photographic silver halide emulsions various synthetic polymeric materials e.g. poly-N-vinyllactams, acrylic polymers, more particularly polyacrylates having a glass transition temperature of less than 20° C. (French Pat. No. 1,571,047 filed Aug. 24, 1968 by Kodak Ltd.), polymers of N-hydroxyalkyl(meth)acrylamides or ethers thereof (Belgian Pat. No. 790,872 filed Nov. 3, 1972 by Agfa-Gevaert N.V.), etc.

These synthetic polymeric materials reduce the tendency to the formation of pressure marks but form a supplemental ballast for the emulsion and may affect the photographic properties. Moreover, they were not found to be very effective in the high-sensitive radiographic elements described.

The present invention provides radiographic silver halide emulsions comprising silver halide grains the average silver halide grain diameter of which is at least 250 nm and which consist substantially of silver bromide dispersed in a hydrophilic colloid binder e.g. gelatin wherein the silver halide grains have high primitive surface sensitivity for direct exposure to penetrating radiation and are substantially regular in shape and wherein the ratio of hydrophilic colloid to silver halide is at most about 1.0, preferably between about 0.2 and about 0.8.

The present invention also provides radiographic silver halide elements comprising a transparent support and on one or both sides thereof such radiographic silver halide emulsions.

The radiographic silver halide emulsions of the invention are themselves substantially insensitive to formation of pressure marks upon rapid processing. They have improved sensitivity for direct exposure to penetrating radiation as compared with conventional radiographic emulsions for such exposures.

By silver halide grains substantially consisting of silver bromide is understood silver bromide, silver bromochloride, silver bromoiodide and silver bromochloroiodide grains comprising at most about 3 mole% of iodide and at most about 10 mole% of chloride.

By silver halide grains of substantially regular shape is meant that at least about 80% by weight of the grains are regular.

By silver halide grains having high primitive surface sensitivity for direct exposure to penetrating radiation is understood that before chemical sensitization of the silver halide grains their surface sensitivity for high-intensity exposures is at least equal to and preferably outranges their internal sensitivity for high-intensity exposures.

The distribution of the primitive surface sensitivity for high intensity exposures i.e. the sensitivity for high intensity exposures before any chemical sensitizers others than those that could be present in an inert photographic gelatin have been added, can easily be determined as is known in the art by comparing the sensitivity obtained after high intensity exposure and development of the surface latent image in a surface developer with the sensitivity obtained after high intensity exposure, bleaching of the surface latent image and development of the internal latent image in an internal developer.

The hydrophilic colloid silver halide emulsions according to the present invention are more particularly silver bromide emulsions, which may comprise at most 10 mole% of silver chloride and at most 3 mole% of silver iodide, of which the ratio of hydrophilic colloid to silver halide expressed as silver nitrate is at most about 1.0 and of which the silver halide grains have an average grain diameter of at least 250 nm and are for at least 80% by weight regular in shape, the said silver halide emulsion having a surface sensitivity measured at density 0.50 above fog according to normal photographic techniques by coating a test portion of the non-chemically sensitized emulsion on a conventional support at a coverage of silver halide corresponding at 10 g of silver nitrate per sq.m at a pH of 6.00 and a pAg of 8.00, exposing for $10^{-4}$ sec in a Mark VI Sensitometer of EG & G, Inc., Boston, Mass. USA using a General Electric type FT 118 electronic flash tube with a radiant energy of 100 Wattsec and developing for 10 min at 20° C. in the surface developer described hereinafter, at least equal to, but preferably at least twice as high as its internal sensitivity measured at density 0.50 above fog by coating and exposing an identical test portion in the same way as the first test portion, then bleaching the portion for 5 min at 20° C. in an aqueous bleaching solution containing 30 g of potassium hexacyanoferrate (III) and 30 mg of phenosafranine pro liter, and developing it for 15 min at 20° C. in the internal developer set forth hereinafter.

Surface developer
p-monomethylaminophenol sulphate: 2.50 g
ascorbic acid: 10.0 g
potassium bromide: 1.0 g
sodium metaborate-4-water: 25.0 g
water to make: 1.0 liter
Internal developer
Same composition as surface developer to which 10 g of anhydrous sodium thiosulphate was added per liter.

The present invention also provides a radiographic material, more particularly a radiographic material for direct exposure to penetrating radiation comprising a transparent support and on one or both sides thereof a layer of a hydrophilic colloid silver halide emulsion as defined hereinbefore. In these materials the emulsion layer(s) is (are) preferably coated so that the total amount of silver halide per sq.m corresponds to from about 13 g to about 40 g, preferably from about 18 g to about 30 g of silver nitrate.

Emulsions of the type described having a primitive surface sensitivity for high intensity exposures equal to or higher than the primitive internal sensitivity and having substantially regular shape can be prepared by controlling the reaction conditions during the steps of grain-formation and grain growth.

Precipitation of the silver halide grains is most advantageously, effected by the double-jet technique wherein an aqueous solution of silver nitrate and an aqueous solution of the halide(s) are simultaneously run into an agitated aqueous solution of a peptizer, e.g. gelatin or a gelatin derivative. To avoid as much as possible the formation of internal sensitivity specks for high intensity exposures the peptizer is photographically inert and precipitation of the silver halide grains is effected in the substantial absence of any sensitizing compounds or metal compounds producing centres promoting the deposition of photolytic silver. To obtain the desired average grain-size, which according to the present invention is preferably comprised between about 250 nm and 1200 nm the precipitation is most advantageously effected in the presence of a silver halide solvent e.g. ammonia, a water-soluble thiocyanate such as potassium or ammonium thiocyanate, or a thioether silver halide solvent e.g. of the type described in U.S. Pat. No. 3,574,628 of Evan T. Jones issued Apr. 13, 1971 and in published German Patent Application No. 2,614,862 filed Apr. 6, 1976 by Agfa-Gevaert A.G. The silver halide solvent can be added to the precipitation medium before addition of the silver salt and halide solutions and/or it may be added with the silver salt and halide solution at any time during addition of the latter e.g. via one of the jets of these solutions or via a separate jet.

During silver halide grain-formation the temperature is generally comprised between about 30° C. and 90° C., it is preferably at least 50° C. In the absence of ammonia as silver halide solvent, the pH is generally maintained at a value comprised between about 2 and about 9. The pAg is preferably not too high when a silver halide solvent is used in order to avoid competition between the silver halide solvent and the excess halide ions which may also act as silver halide solvent. The pAg is generally comprised between 6 and 11, preferably between about 7.5 and about 10.0

Silver halide emulsions with grains of substantially regular shape are known. As disclosed in a paper entitled "Fundamental Aspects of Growth and Shape of Photographic Silver Halide Crystals", published in The Proceedings of the 5th International Conference on Nuclear Photography held at Cern, Geneva, Sept. 15–18, 1965, edited by E. Dahl-Jensen, regular silver halide grains or crystals are obtained by isotropic growth occurring simultaneously and uniformly on all crystal faces. Such crystals develop (1,0,0) or (1,1,1) faces and are free of twin plane stacking faults, e.g., twin planes such as (1,1,1) twin planes. A (1,1,1) twin plane is a stacking fault which arises when a silver halide crystal grows in such a manner as to alter the previously established order of stacking of (1,1,1) planes in forming the crystal.

Photographic silver halide emulsions comprising silver halide grains of regular shape or structure can be obtained by controlling the reaction conditions during the double-run grain-formation procedure. Depending upon these conditions the regular silver halide grains will be characterized by a certain crystal habit, e.g., cubic, cubo-octahedral and/or octahedral, and will exhibit certain planes, e.g., (1,0,0) or (1,1,1) planes, as crystal faces. For example, in an article entitled, "Precipitation of Twinned AgBr Crystals", by Berry and Skillman, Photographic Science and Engineering, vol.6, No.3, May–June 1962, it is known that by a change in pAg it is possible to conduct a double-run precipitation of silver halide in such a manner that regular cubes or octahedra are formed. To obtain substantially regular grains a large excess of halide ion is generally avoided. The conditions employed during the preparation of the silver halide grains are inter-related and a change in one variable such as pAg, pH, etc., while maintaining other conditions constant can change the silver halide crystal structure. In addition to previous references, a suitable method for preparing photographic silver halide emulsions having the required regular shape is also disclosed in the article entitled, "Ia: Properties of Photographic Emulsion Grains", by Klein and Moisar, The Journal of Photographic Science, vol 12, 1964, pp. 242–251. A preferred class of photographic silver halide emulsions employed in the practice of this invention contains regular cubic or cubo-octahedral grains.

The silver halide emulsions according to the present invention of substantially regular shape having a primitive surface sensitivity at least equal to the primitive internal sensitivity can be further characterized as having a low level of grain disorder. Methods for assessing grain-disorder have been described in an article entitled: "Grain Disorder and Its Influence on Emulsion Response" by G. C. Farnell et al, The Journal of Photographic Science, Vol 24, 1976, pp. 1–11.

As is apparent from the Klein-Moisar article referred to hereinbefore silver halide emulsions having grains of substantially regular shape include monodisperse emulsions having grains of substantially uniform grain-size. Monodispersed emulsions are emulsions wherein at least about 80% and generally at least 90–95% by weight of the grains have a diameter which is within about 40%, more particularly within about 30% of the mean grain-diameter. Mean grain-diameter can be determined by conventional techniques e.g. as described by Trivelli and M. Smith, The Photographic Journal, Vol. 69, 1939, p.330–338, Loveland "ASTM symposium on light microscopy" 1953, p.94–122 and Mees and Jones "The theory of the photographic process" (1966), Chapter II.

The silver halide emulsions used according to the present invention to form radiographic materials for direct-exposure to penetrating radiation need not be monodisperse emulsions of substantially uniform grain-size. They may for example be composed of mixtures of monodisperse emulsions having grains of different mean grain diameter the mixtures thus being actually heterodisperse emulsions.

As referred to hereinbefore precipitation may occur in the presence of a silver halide solvent e.g. ammonia, a water-soluble thiocyanate such as potassium or ammonium thiocyanate, or a thioether silver halide solvent e.g. a thioether compound of the type described in U.S. Pat. No. 3,574,628, already mentioned hereinbefore, e.g. 1,8-dihydroxy-3,6-dithiaoctane, 1,10-dithia-4,7,13,16-tetraoxacyclooctadecane, 3,15-dioxa-6,9,12-trithioheptadecane, 1,7-dithia-4,10-dioxacyclododecane, 1,17-di(N-ethylcarbamyl)-6,12-dithia-9-oxaheptadecane, or 6,9-dioxa-3,12-dithiatetradecane, and methionine, ethionine and structurally related thioether compounds having besides thioether S-atom(s) amino and/or carboxyl groups in acid or salt form e.g. S-alkyl cysteines, including derivatives of these thioether compounds e.g. esters and amides, as described in published German Patent Application No. 2,614,862, mentioned hereinbefore. The silver halide solvent may be added to the precipitation medium before addition of the silver salt and halide solutions and/or it may be added with the silver salt and halide solution at any time during addition of the latter e.g. via one of the jets of these solutions or via a separate jet.

In the preparation of the emulsions for use according to the present invention, washing of the emulsions after grain-formation and grain-growth, can be effected by any suitable technique e.g. by leaching in cold water the chill-set and shredded emulsion or by coagulation techniques using e.g. an acid-coagulable gelatin derivative such as phthaloyl gelatin and N-phenylcarbamoyl gelatin (as described in U.S. Pat. Nos. 2,614,928 of Henry C. Yutze and Gordon F. Frame, 2,614,929 of Henry C. Yutze and Frederick J. Russell, both issued Oct. 21, 1952, and 2,728,662 of Henry C. Yutze and Gordon F. Frame, issued Dec. 27, 1955) or anionic polymers e.g. polystyrene sulphonic acid and sulphonated copolymers of styrene (e.g. as described in German Pat. No. 1,085,422 filed Oct. 16, 1958 by Agfa A.G.).

After the washing operation, the coagulum is redispersed to form a photographic emulsion suitable for the subsequent finishing and coating operations by treating, preferably at a temperature within the range of about 35° to about 70° C., with the required quantity of water, normal gelatin, and if necessary alkali for a time sufficient to effect a complete redispersal of the coagulum. Instead or in addition to normal gelatin, which is preferably used, other known photographic hydrophilic colloids can also be used for redispersion and for forming the binder of the silver halide emulsion e.g. a gelatin derivative as referred to above, other natural hydrophilic colloids e.g. albumin, zein, agar-agar, gum arabic, alginic acid, and derivatives thereof e.g. salts, amides and esters, starch and derivatives thereof, cellulose derivatives e.g. cellulose ethers, partially hydrolyzed cellulose acetate, carboxymethyl cellulose, etc. or synthetic hydrophilic resins, e.g. polyvinyl alcohol, polyvinyl pyrrolidone, homo- and copolymers of acrylic and methacrylic acid or derivatives e.g. esters, amides and nitriles, vinyl polymers e.g. vinyl ethers and vinyl esters.

The amount of hydrophilic colloid in the redispersed emulsion is such that the ultimate emulsion has a ratio by weight of hydrophilic colloid to silver halide, expressed as silver nitrate, which is at most about 1.0. It is generally comprised between about 0.2 and about 0.8 and most preferably between 0.3 and 0.6.

The silver halide emulsions according to the present invention having a high primitive surface sensitivity may be further chemically sensitized by any of the accepted procedures, including sulphur sensitization, reduction sensitization and/or noble-metal sensitization e.g. as described on page 107 of the December 1971 issue of "Product Licensing Index" published by Industrial Opportunities Ltd., Havant, England and in the patent literature referred to therein. The emulsion may be digested in the presence of small amounts of sulphur group sensitizers e.g. sulphur, selenium and tellurium sensitizers, e.g. allyl isothiocyanate, thiourea, allyl thiourea, sodium thiosulphate, thioacetamide, allyl selenourea, allyl tellurourea, colloidal selenium, etc. The emulsion may also be sensitized by means of reductors e.g. tin compounds as described in Belgian Pat. Nos. 493,464 filed Jan. 24, 1950 and 568,687 filed June 18, 1958 both by Gevaert Photo-Producten N.V., iminoaminomethane sulphinic acids as described in British Pat. No. 789,823 filed Apr. 24, 1955 by Gevaert Photo-Producten N.V., polyamines e.g. diethylene triamine, spermine and bis($\beta$-aminoethyl)sulphide, thiourea dioxide, etc. Reduction sensitization may also occur by digestion at low pAg values as described by H. W. Wood, J.Phot.Sci. 1 (1953) 163 or by hydrogen-sensitization as described in U.S. Pat. No. 3,891,446 of Gaile A. Januso-nis issued June 24, 1975, the published German Patent Application DT OS No. 2,144,994 filed Sept. 8, 1971 by Kodak Ltd. and Jl.Phot. Sci. Vol. 24, No. 1 page 19.

The emulsions may also be sensitized by noble metal-sensitization. Noble metal sensitization preferably occurs by digestion with a gold compound but any of the other known noble metal sensitizers e.g. ruthenium, rhodium, palladium, iridium and platinum compounds as described by R. Koslowsky, Z.Wiss.Phot. 46, 65–72 (1951) may be used. Representative examples of noble metal sensitizers are gold(III) chloride, gold(I) sulphide, potassium aurithiocyanate, potassium chloroaurate, ammonium chloropalladate, potassium chloroplatinate, etc.

For the preparation of the radiographic material according to the present invention the silver halide emulsions according to the present invention are preferably chemically sensitized by reduction sensitization combined with noble metal sensitization more particularly gold sensitization which leads to favourable relationship between average grain-size, sensitivity and fog.

The emulsions may comprise compounds that sensitize the emulsion by development acceleration for example alkylene oxide polymers. These alkylene oxide polymers may be of various type e.g. polyethylene glycol having a molecular weight of 1500 or more, alkylene oxide condensation products or polymers as described among others in U.S. Pat. Nos. 1,970,578 of Conrad Schoeller and Max Wittner issued Aug. 21, 1934, 2,240,472 of Donald R. Swan issued Apr. 29, 1941, 2,423,549 of Ralph Kinsley Blake, William Alexander Stanton and Ferdinand Schulze issued July 8, 1947, 2,441,389 of Ralph Kinsley Blake issued May 11, 1948, 2,531,832 of William Alexander Stanton issued Nov. 28, 1950, and 2,533,990 of Ralph Kinsley Blake issued Dec. 12, 1950, in United Kingdom Patent Specifications Nos. 920,637 filed May 7, 1959, 940,051 filed Nov. 1, 1961, 945,340 filed Oct. 23, 1961 all by Gavaert Photo-Producten N.V. and 991,608 filed June 14, 1961 by Kodak Co., in Belgian Patent Specification No. 648,710 filed June 2, 1964 by Gavaert-Photo-Producten N.V., and in the published German Patent Applications DT-OS Nos. 2,426,177 filed May 28, 1974 and 2,601,779 filed Jan. 20, 1976 by Agfa-Gevaert A.G. Other compounds that sensitize the emulsion by development acceleration and that are suitable for use in the emulsion according to the invention have been described in U.S. Pat. Nos. 3,523,796 and 3,523,797 of Jozef Frans Willems, Francis Jeanne Sels and Robrecht Julius Thiers both issued Aug. 11, 1970, 3,552,968 of Jozef Frans Willems, issued Jan. 5, 1971, 3,746,545 of Robert Joseph Pollet, Jozef Frans Willems, Francis Jeanne Sels and Herman Adelbert Philippaerts, issued July 17, 1973 and 3,749,574 of Robert Joseph Pollet, Francis Jeanne Sels and Herman Adelbert Philippaerts, issued July 31, 1973.

Other development accelerating compounds are onium and polyonium compounds preferably of the ammonium, phosphonium, and sulphonium type for example trialkyl sulphonium salts such as dimethyl-n-nonyl sulphonium p-toluene sulphonate, tetraalkyl ammonium salts such as dodecyl trimethyl ammonium p-toluene sulphonate, alkyl pyridinium and alkyl quinolinium salts such as 1-m-nitrobenzyl quinolinium chloride and 1-dodecyl pyridinium chloride, bis-alkylene pyridinium salts such as N,N-tetramethylene bispyridinium chloride, quaternary ammonium, sulphonium phosphonium polyoxyalkylene salts, especially polyoxyalkylene bispyridinium salts. Examples of suitable onium compounds can be found in U.S. Pat. Nos. 2,275,727 and 2,288,226 both of Burt H. Carroll and Charles F. H. Allen issued Mar. 10, 1942 and June 30, 1942 respectively, 2,944,900 of Burt H. Carroll, Hubert S. Elins, James L. Graham and Charles V. Wilson and 2,944,902 of Burt H. Carroll, John Sagal Jr. and Dorothy J. Beavers, both issued July 12, 1960, French Pat. No. 1,506,229 filed Dec. 28, 1966 by Agfa A.G. and the published German Patent Application DT-OS No. 2,508,280 filed Feb. 26, 1975 by Agfa-Gavaert A.G. Also suitable are organic compounds comprising thioether S-atoms e.g. of the type described in U.S. Pat. Nos. 3,046,129 of James L. Graham and John Sagal Jr., 3,046,132 and 3,046,133 both of Louis M. Minsk, 3,046,134 of John R. Dann and Jonas J. Chechak, all issued June 24, 1962 and 3,036,134 of William Judson Mattox issued May 22, 1962, in French Pat. No. 1,351,410 filed Sept. 6, 1962 by Kodak Co., in British Pat. Nos. 931,018 filed Apr. 7, 1961 by Agfa A.G. and 1,249,248 filed Dec. 9, 1969 by Konishiroku Photo Industry Co. Ltd., and in the published German Patent applications Nos. 2,360,878 filed Dec. 6, 1973, 2,601,779 and 2,601,814, both filed Jan. 20, 1976, all by Agfa-Gavaert A.G.

The emulsions may comprise the common emulsion stabilizers e.g. homopolar or salt-like compounds of mercury with aromatic and heterocyclic rings (e.g. mercaptotriazoles) simple mercury compounds, mercury sulphonium double salts and other mercury compounds of the kind described in Belgian Patent Specifications Nos. 524,121 filed Nov. 7, 1953 by Kodak Co., 677,337 filed Mar. 4, 1966, 707,386 filed Dec. 1, 1967 and 709,195 filed Jan. 11, 1968 all by Gevaert-Agfa N.V. Other suitable and preferred emulsion stabilizers are the well-known azaindenes, particularly the tetra- or pentaazaindenes and especially those substituted by hydroxy- or amino groups. Suchlike compounds have been described by Birr in Z.Wiss.Phot. 47, 2–58 (1952) and in U.S. Pat. Nos. 2,444,605 of Newton Heimbach and Walter Kelly, Jr., 2,444,607 of Newton Heimbach, 2,444,609 of Newton Heimbach and Robert H. Clark, all issued July 6, 1948 and 2,450,397 of Newton Heimbach, issued Sept. 28, 1948. The emulsions may further comprise as stabilizers heterocyclic nitrogen-containing mercapto compounds such as benzothiazoline-2-thione and 1-phenyl-5-mercaptotetrazole, sulphinic acids and seleninic acids as described in U.S. Pat. No. 2,057,764 of Johannes Brunken, issued Oct. 20, 1936, representatives of which are benzenesulphinic acid and toluenesulphinic acid, in acid or salt form, the amide stabilizers e.g. acetamide described in British Pat. No. 1,325,878 filed Nov. 3, 1969 by Gevaert-Agfa N.V. and the disulphides described in U.S. Pat. No. 3,761,277 of Antoon Leon Vandenberghe, Jozef Frans Willems, Robert Joseph Pollet, Gaston Jacob Benoy and Marcel Karel Van Doorselaer. Especially suitable are thiosulphonic acids in acid or salt form as described in U.S. Pat. No. 2,394,198 of Fritz W. H. Mueller, issued Feb. 5, 1946, representatives of which are benzenethiosulphonic acid, toluenethiosulphonic sodium salt, p-chlorobenzenethiosulphonic acid sodium salt, propylthiosulphonic acid potassium salt, butylthiosulphonic acid potassium salt, as well as derivatives of these thiosulphonic acids e.g. the polythionic acids and thioanhydrides of sulphonic acids described in U.S. Pat. No. 2,440,206 of Fritz W. H. Mueller, issued Apr. 20, 1948, e.g. dibenzene disulphonyl trisulphide. Other very suitable emulsion stabilizers are the selenium compounds of the type described in GBP No. 1,323,111 filed Apr. 1, 1970 by Agfa-Gevaert N.V. which include diselenides and selenocyanates e.g. di(3-carboxylpropyl) diselenide, di(2-aminoethyl) diselenide hydrochloride, di(2-acetylaminoethyl)diselenide, di(2-benzoylaminoethyl)diselenide, dibenzyl diselenide, diphenyl diselenide, di-β-naphthyl diselenide, di(p-bromophenyl)diselenide, di(p-chlorophenyl)-diselenide, di(m-chlorophenyl)diselenide, di(m-carboxyphenyl)diselenide, di(p-carboxyphenyl)diselenide, di(p-nitrophenyl)diselenide, di(3-indolyl)diselenide, hexadecylselenocyanate, 2-carboxyethylselenocyanate, 3-sulphopropylselenocyanate, carbamoylmethylselenocyanate, phenylselenocyanate, p-chlorophenylselenocyanate, m-chlorophenylselenocyanate, p-bromophenylselenocyanate and p-nitrophenylselenocyanate, and 2-methyl-benzthiazoyl-6-selenocyanate. The above sulphinic acids, seleninic acids, thiosulphonic acids and derivatives and selenium compounds are preferably used at the stage of chemical sensitization or added to the emulsion immediately thereafter. The emulsions according to the present invention are preferably stabilized by means of azaindene stabilizers as referred to above and a member selected from carbocyclic aromatic thiosulphonic acids or salts thereof, carbocyclic aromatic diselenides and carbocyclic aromatic selenocyanates representative examples of which have been given hereinbefore.

The materials of the invention may further comprise or be developed in the presence of compounds that are particularly effective as antifoggants for materials that are processed at elevated temperatures e.g. heterocyclic compounds with nitro-substituents e.g. nitroindazole and nitrobenzotriazole as described in French Patent Specification No. 2,008,245 filed May 9, 1969 by Eastman Kodak Co, 1H-6-methylbenzotriazole, nitrobenzylidene pyridinium and nitrobenzylidene quinolinium compounds as well as the onium compounds described in published German Patent Application No. 2,040,876 filed Aug. 18, 1970 by Konishiroku Photo Industry Co. Ltd.; further the nitrobenzene compounds described in British Pat. No. 1,399,449 filed Sept. 17, 1971 by Agfa-Gevaert N.V. and the nitrile compounds described in British Pat. No. 1,395,161 filed Sept. 17, 1971 by Agfa-Gevaert N.V. The developer may also comprise development accelerators e.g. polyoxyalkylene compounds and onium compounds of the type referred to hereinbefore.

When reduction-sensitized emulsions of the present invention are developed in developers comprising a high concentration of silver halide solvent e.g. sulphite ion, the developers preferably also comprise antifoggants as disclosed in RD 13654 of the August 1975 issue of "Research Disclosure" Havant, England e.g. azaindenes and heterocyclic mercapto compounds as referred to hereinbefore for use in the emulsion.

The photographic silver halide materials may further comprise surface-active compounds, which include anionic, non-ionic and amphoteric surfactants, e.g. long-chain aliphatic sulphates, sulphonates and carboxylates or alkylaryl sulphates, sulphonates and carboxylates which may comprise recurring ethylene oxide units, polyoxyethylene compounds, the fluorinated surfactants of Belgian Patent Specification No. 742,680 filed Dec. 5, 1969 by Gevaert-Agfa N.V., etc. plasticizers, matting agents, e.g. polymethyl methacrylate and silica particles, compounds increasing silver covering power e.g. dextran, lactose, poly-N-vinyllactams, etc., colour couplers, hardening agents e.g. formaldehyde, dialdehydes, halogen-substituted aldehyde acids such as mucochloric and mucobromic acid, hardening accelerators e.g. recorsinol, phloroglucinol, etc.

The silver halide emulsions according to the present invention may be coated on one or both sides of the wide variety of transparent supports known for use in photographic silver halide elements, which include cellulose nitrate film, cellulose acetate film, poly(vinyl acetal) film, polystyrene film, poly(ethylene terephthalate) film, polycarbonate film and related films of resinous materials.

The silver halide emulsions of the present invention are coated at coverages corresponding to from about 13 g to about 40 g of silver nitrate per sq.m of support. For recording X-ray exposures or exposures with other penetrating radiation, the emulsions are generally coated on both sides of the support at coverages corresponding to from about 6.5 g to about 20 g of silver nitrate per sq.m of support and per side.

In the automatic processing, especially at elevated temperatures, of radiographic silver halide elements according to the present invention it is preferred to use a hardening developer. In these developers the hardening agent is generally an aldehyde hardener particularly aliphatic dialdehydes e.g. maleic aldehyde and glutaraldehyde which may be used as such or in the form of their bisulphite addition products.

The following examples illustrate the present invention.

EXAMPLE 1

Emulsion I (comparison emulsion)

A conventional ammoniacal heterodisperse and irregular silver bromoiodide emulsion for non-destructive testing with an average grain diameter of 700 nm and containing 0.35 mole % of iodide was prepared by adding over a period of about 7 minutes a 3 molar ammoniacal silver nitrate solution to an agitated aqueous gelatin solution to which a 3 molar ammonium bromide and 3 molar potassium iodide solution had been added in an amount equivalent to the amount of silver nitrate and so that the above ratio of bromide to iodide is obtained. The temperature was kept at 38° C.

After a physical ripening stage of 4 minutes, the emulsion was coagulated by the addition of ammonium sulphate, washed and redispersed in the usual manner.

Finally, water and gelatin were added in order to obtain a concentration of silver halide expressed as silver nitrate, of 200 g per kg emulsion and a ratio of gelatin to silver halide (expressed as silver nitrate) of 0.4.

Emulsion II

A monodispersed cubo-octahedral regular silver bromide emulsion, having an average grain size of 800 nm was prepared by adding simultaneously over a period of about 45 minutes a 3 molar aqueous solution of silver nitrate and a 3 molar aqueous solution of potassium bromide at a rate of 50 ml/minute to an agitated gelatin solution containing 40 g of dl-methionine.

The temperature was maintained at 65° C., the pH at 4 and the pAg at 8.2 during the precipitation. After a physical ripening stage of 10 minutes, the emulsion was cooled to 40° C. and the pH was lowered to 3 by the addition of diluted sulphuric acid. The emulsion was coagulated by adding a solution of polystyrene sulphonic acid, washed and redispersed in the usual manner.

Finally, water and gelatin were added in order to obtain a concentration of silver halide expressed as silver nitrate of 200 g per kg emulsion and a ratio of gelatin to silver halide (expressed as silver nitrate) of 0.4.

Emulsion III

A monodispersed cubo-octahedral regular silver bromoiodide emulsion having an average grain diameter of 700 nm and containing approximately 0.5 mole % of iodide is prepared by adding simultaneously an ammoniacal silver nitrate solution and an aqueous solution of potassium bromide and potassium iodide (the halide being used in an excess amount of 15 mole %) to an agitated aqueous gelatin solution brought at a pH of 3 by the addition of dilute sulphuric acid. The temperature throughout the addition is maintained at 50° C.

The emulsion was thereafter coagulated with polystyrene sulphonic acid, the coagulation being effected at a pH of 3.5. The resulting coagulant was washed and redispersed in the usual manner. Water and gelatin were added in order to obtain a concentration of 200 g of silver halide, expressed as silver nitrate, per kg of emulsion and a ratio of gelatin to silver halide, expressed as silver nitrate, of 0.4.

In order to determine the internal and surface sensitivity for high energy exposures of the primitive emulsions made, test portions of the emulsions were coated at pH 6.0 and pAg 8.0 on one side of a film support at coverages of 10 g of silver halide, expressed as silver nitrate, per sq.m. and the coated emulsions were exposed for $10^{-4}$ sec in a Mark VI Sensitometer of EG&G, Inc., Boston, Mass., USA using a General Electric type FT 118 electronic flash tube with a radiant energy of 100 Wattsec.

The surface sensitivity was measured at density 0.5 above fog after processing as follows:

5 min rinsing in running tap water (15° C.)
10 min development at 20° C. in the surface developer of the composition:
p-monomethylaminophenol sulphate: 2.50 g
d-isoascorbic acid: 10.0 g
potassium bromide: 1.0 g
sodium metaborate-4-water: 35.0 g
water to make: 1.0 liter
5 min rinsing in running tap water (15° C.)
10 min fixing at 20° C. in the fixing bath of the following composition:
anhydrous sodium thiosulphate: 130.0 g
potassium metabisulphite: 25.0 g
water to make: 1.0 liter (pH: 4.55)
and
10 min rinsing in running tap water (15° C.)

The internal sensitivity was measured at density 0.5 above fog after processing as follows:

5 min rinsing in running tap water (15° C.)
5 min treating at 20° C. in an aqueous bleaching solution containing 30 g of potassium hexacyanoferrate (III) and 30 mg of phenosafranine per liter,
5 min rinsing in running tap water (15° C.)
15 min development at 20° C. in the internal developer of the composition obtained by adding 10 g of anhydrous sodium thiosulphate to 1 liter of the above surface developer,
5 min rinsing in running tap water (15° C.)
10 min fixing at 20° C. in the above fixing solution, and
10 min rinsing in running tap water.

The results are listed in the following table 1. The values given for the relative sensitivity are log Et values. The sensitivity is higher as the log Et values are lower with Δ log Et equal to 0.30 meaning a sensitivity increase or decrease by a factor 2.

Table 1

| emulsion | relative surface sensitivity (log Et values) | relative internal sensitivity (log Et values) |
|---|---|---|
| I | 1.72 | 1.35 |
| II | 1.25 | 1.93 |
| III | 1.20 | >3.00 |

From the above values it is apparent that emulsions II and III have higher primitive surface sensitivity than emulsion I and that contrary to emulsion I their primitive surface sensitivity outranges their primitive internal sensitivity. Taking into account that Δ log Et=0.30 means a factor 2 it can be calculated that the ratio of relative internal sensitivity to relative surface sensitivity is for emulsion I 100:57, for emulsion II 100:478 and for emulsion III 100:6400.

The emulsions I, II and III were divided into several aliquot portions. Of each emulsion type, some portions were chemically sensitized using the sensitizers listed in the table hereinafter while other portions were not chemically sensitized. Moreover, some portions were stabilized by addition of a stabilizer while others were not. After addition of hardener, resorcinol and coating aid, the emulsion portions were coated on both sides of a film support so that per side about 13 g of silver halide (expressed as silver nitrate) was present per sq.m.

The photographic elements formed were exposed in a sensitometer and then processed in a 90 seconds automatic processing machine wherein the elements were developed for 20 seconds at 38° C. in a developer comprising hydroquinone and N-monomethyl-p-aminophenol as developing agents and glutaraldehyde as hardener.

After processing the elements were evaluated visually as regards the pressure marks formed. The elements are given a value from 0 to 5 where 0 stands for no pressure marks and 5 stands for heavy formation of pressure marks. The values given are listed in the following table.

| chemical sensitizers (mg/mole AgBr) | 5-methyl-7-hydroxy-s-triazolo [1,5-a]-pyrimidine as stabilizer (mg/mole AgBr) | value for pressure marks in the elements with emulsion I (comparison) | emulsion II | emulsion III |
|---|---|---|---|---|
| none | none | 1 | 0 | 0 |
| none | 222 mg | 1 | 0 | 0 |
| 1.02 mg of anhydrous sodium thiosulphate | 222 mg | 2 | 0 | 0 |
| 0.068 mg of thiourea dioxide + 0.306 mg of hydrogen tetrachloroaurate(III) | none | 2 | 0 | 0 |
| 0.068 mg of thiourea dioxide + 0.306 mg of hydrogen tetrachloroaurate(III) | 222 mg | 4 | 2 | 1 |
| 0.136 mg of thiourea dioxide + 0.612 mg of hydrogen tetrachloroaurate(III) + 0.68 mg of toluene thiosulphonic acid | none | 5 | 0 | 1 |

The above results show that as compared with the ammoniacal heterodisperse, irregular emulsion, the emulsions according to the present invention show less tendency to formation of pressure marks.

EXAMPLE 2

The emulsions I, II and III were reduction and gold-sensitized in the presence of toluene thiosulphonic acid by addition of 1.4 mg of thiourea dioxide, 1.05 mg of hydrogen tetrachloro aurate(I)-4-water and 0.7 mg of toluene thiosulphonic acid per mole of silver halide and heating at 50° C., pAg 8.2 and pH 6.5 until the optimum sensitivity-fog relationship was reached (3 h 30 min).

To each of the chemically sensitized emulsions, 5-methyl-7-hydroxy-s-triazolo-[1,5-a]pyrimidine was added as an emulsion stabilizer in an amount of 5 mmole per mole of silver halide. After addition of coating aids the emulsions were coated at pH 5 and pAg 8.5 on both sides of a film support at a total coverage of silver halide corresponding to 30 g per sq.m of silver nitrate.

The materials obtained were exposed in an X-ray sensitometer using a röntgen tube so that at a distance of one yard the half layer value is 0.5 mm Cu (about 85 KV and 10 mA).

The exposed emulsions were developed for 7 min at 21° C. in a developer comprising:

p-monomethylaminophenol sulphate: 3.5 g
anhydrous sodium sulphite: 60 g
hydroquinone: 10 g
boric acid: 7.5 g
sodium hydroxide: 17.5 g
potassium bromide: 4 g
water to make: 1000 ml (pH±11)

and then fixed and rinsed in the usual way.

The sensitometric values obtained with fresh materials and materials stored before exposure and processing for 36 hours at 57° C. and 34% relative humidity are listed in the following table 1. The values given for the speed are relative log Et values measured at density 2 above fog. A decrease of the value by 0.30 means a doubling of the speed.

Table 1

| emulsion | fresh materials fog | relative speed | gamma | stored materials fog | relative speed | gamma |
|---|---|---|---|---|---|---|
| I | 0.15 | 1.43 | 4.22 | 0.24 | 1.42 | 4.84 |
| II | 0.05 | 1.25 | 4.61 | 0.05 | 1.24 | 4.41 |
| III | 0.04 | 1.25 | 4.76 | 0.03 | 1.19 | 4.84 |

From the above results it is apparent that the materials containing emulsion layers from emulsions II and III according to the present invention have higher speed and better fog values than the material with the comparison emulsion I. The emulsions are also characterized by high stability against fog increase and speed decrease upon storing.

EXAMPLE 3

Emulsions I and II of example 1 were chemically sensitized by one of the following procedures:

A. Reduction and gold sensitization in the presence of toluene thiosulphonic acid by addition of 1.4 mg of thiourea dioxide, 1.05 mg of hydrogen tetrachloroaurate(I)-4-water and 0.7 mg of toluene thiosulphonic acid per mole of silver halide and heating at 50° C., pH 6.5 and pAg 8.2 until the optimum sensitivity-fog relationship was reached.

B. Sulphur and gold sensitization in the presence of toluene thiosulphonic acid by addition of 1.05 mg of sodium thiosulphate, 1.8 ml of a 1.5 $10^{-3}$ molar solution of potassium aurithiocyanate and 1.3 mg of sodium sulphite and 0.7 mg of toluenethiosulphonic acid per mole of silver halide and heating at 50° C. pAg 7.8 and pH 6 until the optimum sensitivity-fog relationship was reached.

To each of the chemically sensitized emulsions 5-methyl-7-hydroxy-s-triazolo[1,5-a]pyrimidine was added in an amount of 5 mmole per mole of silver halide. After addition of coating aids the emulsions were coated at pH 5 and pAg 8.5 on both sides of a film support at a total coverage of silver halide corresponding to 30 g per sq.m of silver nitrate. The emulsion layers were overcoated with a gelatin antistress layer.

The materials obtained were exposed in an X-ray sensitometer and then processed as described in example 2. The relative speed and fog values obtained with fresh materials and materials stored before exposure and processing for 36 hours at 57° C. and 34% relative humidity are listed in the following table 2. The values given for the relative speed are relative Log Et values measured at density 2 above fog. A decrease of the value by 0.30 means a doubling of the speed.

Table 2

| | | fresh material | | stored material | |
|---|---|---|---|---|---|
| emulsion | chemical sensitization | fog | rel. speed | fog | rel. speed |
| I | A | 0.04 | 1.69 | 0.04 | 1.59 |
| | B | 0.15 | 1.31 | 0.21 | 1.31 |
| II | A | 0.06 | 1.19 | 0.07 | 1.19 |
| | B | 0.18 | 1.16 | 0.27 | 1.14 |

The above results learn that emulsion II has higher speed than emulsion I for X-ray exposures.

They also learn that whereas for emulsion II approximately the same speed values are obtained by the two chemical sensitization procedures, highest speed is obtained for conventional emulsion I by a combined sulphur-gold sensitization (B).

We claim:

1. A radiographic material for direct-exposure to penetrating radiation without fluorescent screens, comprising a transparent support and on one or both sides thereof a layer of a hydrophilic colloid silver halide emulsion whereby the total amount of silver halide per sq.m. corresponds to from about 13 g to about 40 g of silver nitrate, wherein:

(1) the halide of the silver halide emulsion substantially consists of bromide but may comprise at most 10 mole % of chloride and at most 3 mole % of iodide, (2) the ratio of hydrophilic colloid to silver halide, expressed as silver nitrate, is at most about 1.0, (3) the silver halide grains have an average grain diameter of at least 250 nm and are for at least 80% by weight regular in shape, and (4) the emulsion is such that it has a surface sensitivity, measured at density 0.50 above fog according to normal photographic techniques by coating a test portion of the non-chemically sensitized emulsion on a conventional support at a coverage of silver halide corresponding to 10 g of silver nitrate per sq.m. at a pH of 6.00 and a pAg of 8.00, exposing for $10^{-4}$ sec in a Mark VI Sensitometer of EG & G, Inc., Boston, Mass. USA using a General Electric type FT 118 electronic flash tube with a radiant energy of 100 Wattsec and developing for 10 min at 20° C. in the surface developer described hereinafter, at least equal to its internal sensitivity measured at density 0.50 above fog by coating and exposing an identical test portion in the same way as the first test portion, then bleaching the portion for 5 min at 20° C. in an aqueous bleaching solution containing 30 g of potassium hexacyanoferrate (III) and 30 mg of phenosafranine pro liter, and developing it for 15 min at 20° C. in the internal developer set forth hereinafter—

Surface developer p-monomethylaminophenol sulphate: 2.50 g
ascorbic acid: 10.0 g
potassium bromide: 1.0 g
sodium metaborate-4-water: 35.0 g
water to make: 1.0 l Internal developer Same composition as surface developer to which 10 g of anhydrous sodium thiosulphate was added per liter.

2. A radiographic material according to claim 1, wherein at least 80% by weight of the silver halide grains have a diameter which is within about 40% of the mean grain diameter.

3. A radiographic material according to claim 1, wherein the ratio of hydrophilic colloid to silver halide, expressed as silver nitrate, is comprised between about 0.2 and about 0.8.

4. A radiographic material according to claim 1, wherein the emulsion has been chemically sensitized by reduction sensitization, sulphur sensitization and/or noble metal sensitization.

5. A radiographic material according to claim 4, wherein the emulsion has been chemically sensitized by a combined reduction-gold sensitization.

6. A radiographic material according to claim 5, wherein reduction sensitization occurred by digestion of the emulsion with thiourea dioxide.

7. A radiographic material according to claim 5, wherein reduction sensitization occurred by digestion at low pAg values.

8. A radiographic material according to claim 1, wherein the emulsion comprises a stabilizing amount of a thiosulphonic acid, diselenide or selenocyanate.

9. A radiographic material according to claim 8, wherein the emulsion comprises a stabilizing amount of a carbocyclic aromatic thiosulphonic acid, a carbocyclic aromatic diselenide or a carbocyclic aromatic selenocyanate.

10. A radiographic material according to claim 8, wherein the thiosulphonic acid, diselenide or selenocyanate has been added at the stage of chemical sensitization.

11. A radiographic material according to claim 1, wherein the emulsion comprises an azaindene emulsion stabilizer.

12. In a method of producing radiographs by direct exposure to penetrating radiation without fluorescent screens and automatic processing of radiographic material the improvement which comprises using as radiographic material a material comprising a transparent support and on one or both sides thereof a layer of a hydrophilic colloid silver halide emulsion whereby the total amount of silver halide per sq.m. corresponds to from about 13 g to about 40 g of silver nitrate, wherein:

(1) the halide of the silver halide emulsion substantially consists of bromide but may comprise at most 10 mole % of chloride and at most 3 mole % of iodide, (2) the ratio of hydrophilic colloid to silver halide, expressed as silver nitrate, is at most about 1.0, (3) the silver halide grains have an average grain diameter of at least 250 nm and are for at least 80% by weight regular in shape, and (4) the emulsion is such that it has a surface sensitivity measured at density 0.50 above fog according to normal photographic techniques by coating a test portion of the non-chemically sensitized emulsion on a conventional support at a coverage of silver halide corresponding to 10 g of silver nitrate per sq.m. at a pH of 6.00 and a pAg of 8.00, exposing for $10^{-4}$ sec in a Mark VI Sensitometer of EG & G, Inc., Boston, Mass. USA using a General Electric type FT 118 electronic flash tube with a radiant energy of 100 Wattsec and developing for 10 min at 20° C. in the surface developer described hereinafter, at least equal to its internal sensitivity measured at density 0.50 above fog by coating and exposing an identical test portion in the same way as the first test portion, then bleaching the portion for 5 min at 20° C. in an aqueous bleaching solution containing 30 g of potassium hexacyanoferrate (III) and 30 mg of phenosafranine pro liter, and developing it for 15 min at 20° C. in the internal developer set forth hereinafter—

Surface developer p-monomethylaminophenol sulphate: 2.50 g
ascorbic acid: 10.0 g
potassium bromide: 1.0 g
sodium metaborate-4-water: 35.0 g
water to make: 1.0 l Internal developer Same composition as surface developer to which 10 g of anhydrous sodium thiosulphate was added per liter.

13. The method according to claim 12 wherein the emulsion has been chemically sensitized by reduction sensitization, sulphur sensitization and/or noble metal sensitization.

14. The method according to claim 13 wherein the emulsion has been chemically sensitized by a combined reduction-gold sensitization.

* * * * *